US005800317A

United States Patent [19]

Accetta

[11] Patent Number: 5,800,317

[45] Date of Patent: Sep. 1, 1998

[54] FOUR WHEEL SIDE SUPPORT KNEELING WALKER

[76] Inventor: Roderick William Accetta, 1124 Charles Dr., Dover, Del. 19904

[21] Appl. No.: 494,589

[22] Filed: Jun. 23, 1995

Related U.S. Application Data

[63] Continuation of Ser. No. 212,914, Mar. 14, 1994, abandoned.

[51] Int. Cl.[6] ..... A63H 3/00

[52] U.S. Cl. ..... 482/66; 482/68; 135/67; 280/87.021

[58] Field of Search ..... 606/241; 280/87.05, 280/75.5, 649, 87.02, 32.5, 87.21; 482/66, 67, 68; 135/65, 66, 67, 174

[56] References Cited

U.S. PATENT DOCUMENTS 2,651,097 9/1953 Warren ..... 155/22

3,532,356 10/1970 Lillibridge ..... 482/68

4,867,188 9/1989 Reid ..... 135/67

*Primary Examiner*—Jerome Donnelly

[57] ABSTRACT

The invention relates to wheelchairs, walkers, scooters, etc. used by disabled or recuperating persons in cases of injury or disablement of the lower leg, ankle or foot. In particular the invention relates to an asymmetrical side support four wheel side support kneeling walker to be used when a person's lower leg, ankle or foot is non-functional. Balance is provided by a side extension, similar to a training wheel, which extends outward from the same side of the walker as the immobilized leg. This side extension serves as an outrigger to give the wheels of the walker an asymmetrical arrangement relative to the center axis of the vehicle. The foot and leg support rectangular platform and tubular frame are adjustable. It is preferred that the device be easily folded for storage and constructed of steel tubing for durability and strength and have a hand brake for stability and safety.

1 Claim, 4 Drawing Sheets

FOUR WHEEL SIDE SUPPORT KNEELING WALKER

RELATED APPLICATION

This is a continuation application of Ser. No. 08/212,914 filed Mar. 14, 1994 now abandoned.

BACKGROUND OF THE INVENTION

Wheelchairs and walkers continue to be employed almost exclusively for the care and rehabilitation of patients who are unable to walk unsupported on their own legs. Even when using a cane to assist walking with it is not fully satisfactory due to uneven body stress. While there have been many proposed designs for three, four and even five wheel devices to assist non ambulatory persons and patients, it does not appear that these prior art devices have reached general acceptance in the same way as wheelchairs and walkers.

1. Field of the Invention

The invention relates to wheelchairs, walkers, scooters, etc. used by disabled or recuperating persons in cases of injury or disablement of the lower leg, ankle or foot. In particular the invention relates to an asymmetrical side support four wheel side support kneeling walker to be used when a person's lower leg, ankle or foot is non functional.

Balance is provided by a side extension, similar to a training wheel, which extends outward from the same side of the walker as the immobilized leg. This side extension serves as an outrigger to give the wheels of the walker an asymmetrical arrangement relative to the center axis of the vehicle. The foot and leg support rectangular platform and tubular frame are adjustable. It is preferred that the device be easily folded for storage and constructed of steel tubing for durability and strength and have a hand brake for stability and safety.

2. Description of the Prior Art

A common feature of prior art devices is that they exhibit a symmetrical placement of wheels or castors. This symmetry is illustrated in U.S. Pat. Nos. 2,652,097, 3,180,678, 3,847,409, 4,065,145, 4,159,110, 4,239,248, 4,307,715, 4,861,051, 4,867,188, and 5,158,313. Viewing the prior art as a whole, there was no suggestion that any other type of wheel placement than a symmetrical design would be satisfactory for a patient with one leg immobilized and one leg having normal functionality.

SUMMARY OF THE INVENTION

It is an object of the invention to provide an improved four wheel kneeling walker having greater stability by providing an asymmetrical side support with respect to the center line of the vehicle. This stability to avoid tipping is provided by a four wheel asymmetrical walker vehicle where one leg is supported in a kneeling position and the other leg can be employed for locomotion. In particular the pair of wheels opposite to the side where the leg is used for locomotion are offset to provide adequate support so that the walker vehicle does not tip over either while stationary or in motion.

A preferred four (4) wheel device consists essentially of a cushioned support over a rectangular platform on which the kneeling leg can rest, a hand-grasping support to guide the walker and four (4) asymmetrical wheels connected to a supporting frame to provide side support for the kneeling leg. It is most preferred that the rear cushion be adjustable, that the device be easily folded for storage, and have a hand applied brake to control speed and provide stability.

DETAILED DESCRIPTION OF THE PREFERRED EMBODIMENT

Figure 1:
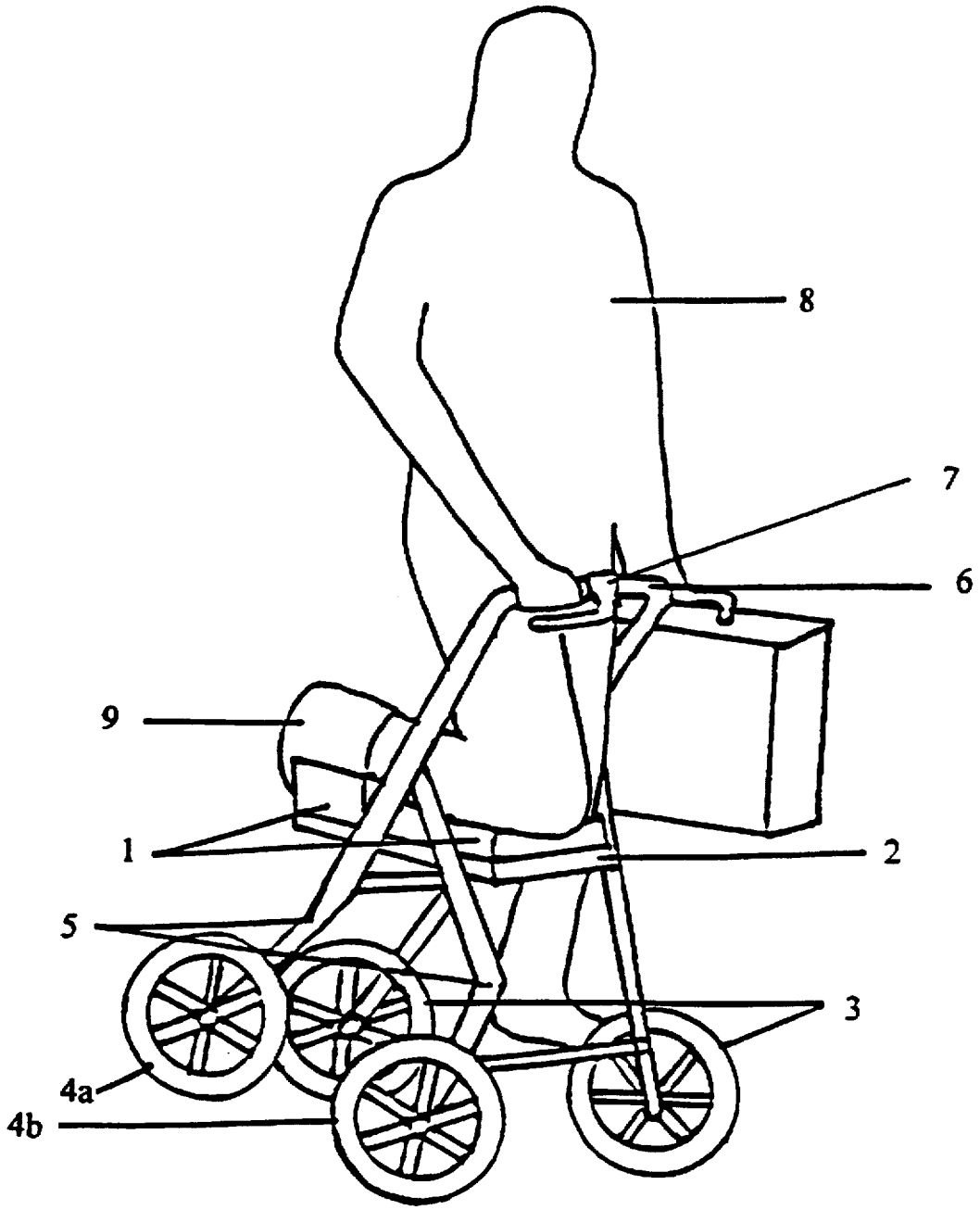
FIG. 1 An angle view illustrates a person with a foot cast using a kneeling walker assembled for a right leg injured person.

FIG. 1 A preferred walker vehicle comprises 1. an adjustable two piece cushioned support for the disabled or injured lower leg, ankle or foot, 2, a rectangular platform supporting the two cushions. 3. four (4) adjustable wheels mounted at base of tubular support frame, 4a. and 4b. asymmetrical mounted wheels, 5. asymmetrical two piece hinged tubular frame support, 6. adjustable height hand grip, 7. a hand applied brake, whereupon 8. a person with 9. a foot cast can kneel and propel it with the other leg while having the foot elevated with respect to the knee and use only one hand so that the walker can be used without tipping over either while moving or shifting weight.

Figure 2:
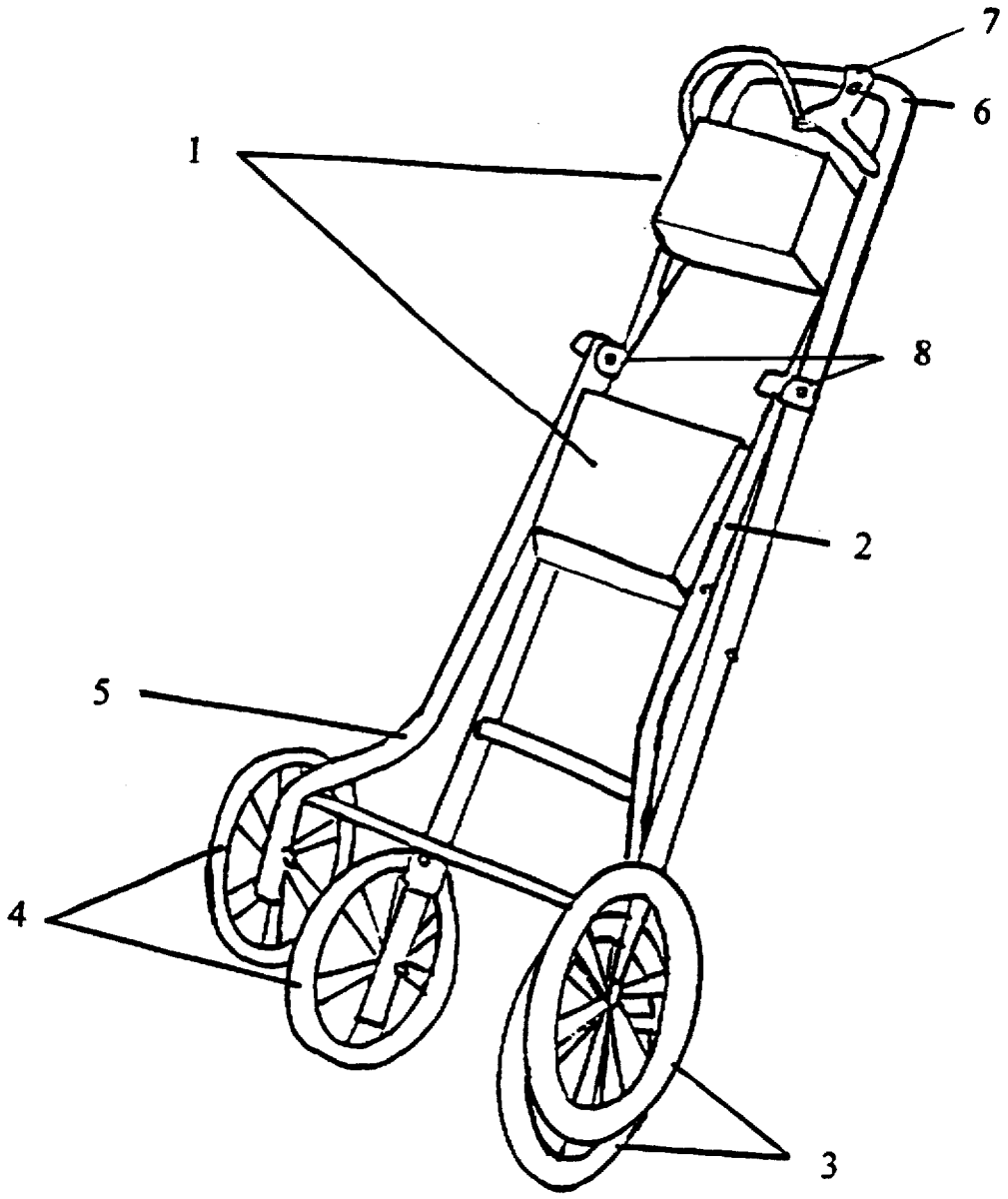
FIG. 2 An angle view illustrates a folded kneeling walker.

FIG. 2 An alternate version of an asymmetrical side support four wheel kneeling walker is shown comprising 1. an adjustable leg support cushioned platform, 2. an asymmetrical two piece hinged tubular frame support, 3. wheels mounted to lower portion of tubular frame support 4. wheels mounted to offset lower portion of tubular frame support, 5. asymmetrical tubular frame support, 6. hand grips, 7. hand brake, and 8. hinged frame brackets.

Figure 3:
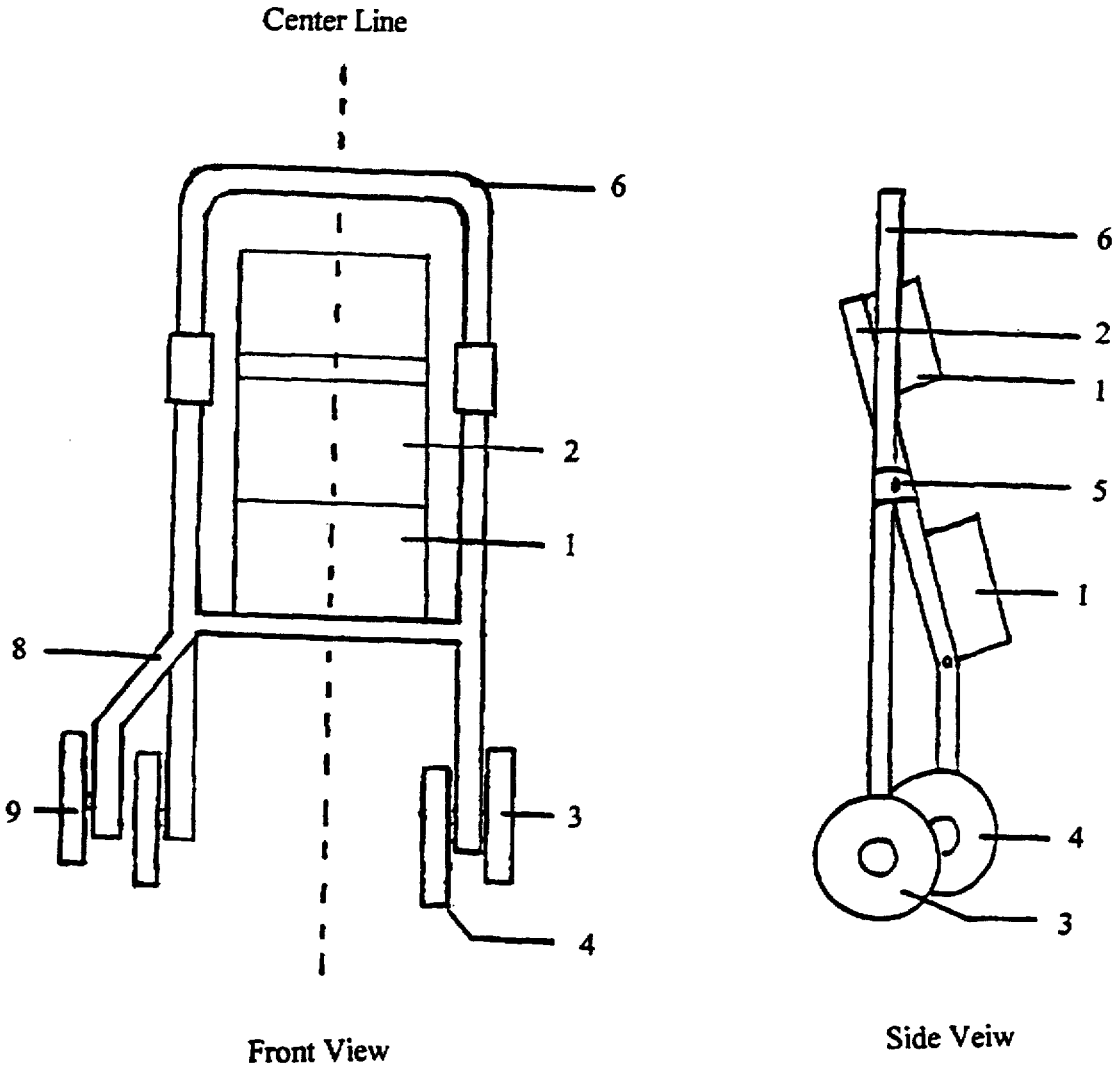
FIG. 3 A kneeling walker is shown in a front view and in a side view in a folded position for storage.

FIG. 3 A kneeling walker illustrated both in an in use and folded position is shown where the device has been assembled as a right leg kneeling walker but can be assembled as a left leg walker comprising 1. cushioned supports, 2. adjustable rectangular platform, 3. two sets of direct downward wheels, 4. two wheels offset for balance, 5. attached to asymmetrical two piece hinged tubular frame support and 6. hand grip.

Figure 4:
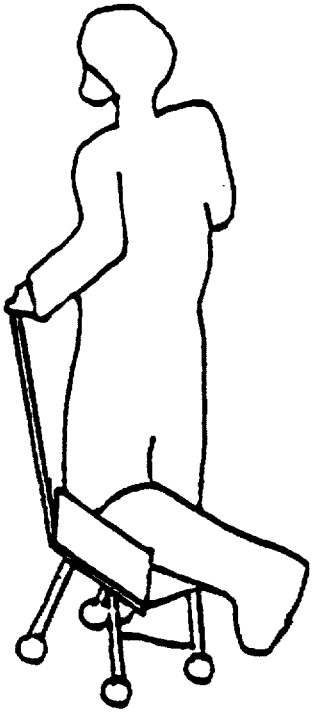
FIG. 4 A rear angle view of a prior art four castor wheel kneeling walker with symmetrical wheel arrangement.

FIG. 4 A prior art four wheel trolley is shown wherein the wheels are symmetrical with respect to a center axis of the rectangular frame and kneeling leg with no provision for side support.

BEST MODE FOR CARRYING OUT THE INVENTION

For the majority of cases in which a person can not use one leg for support either temporarily or permanently, it is necessary to use the conventional wheelchair for lack of a good alternative. This is in spite of many aforementioned three, four and even five wheeled vehicle and scooter designs having a variety of steering wheels, fixed wheels and castor wheels which have appeared in the prior art. This would suggest that some basic feature may have been missing from past designs or that they were more complex or expensive to manufacture than the ever available wheelchair. Thus an ongoing need existed for the situation in which a person had just one leg immobilized and the other leg was available for balancing and propelling.

It has been discovered by building and testing designs for use of persons and patients with a kneeling immobilized leg that it is necessary to provide asymmetrical side support in order to provide adequate support while the vehicle is in motion or at rest. That is to say that the two wheels opposite from the mobile leg must be offset with respect to the rectangular platform. It has further been found that it is convenient to construct this four wheel walker with hinged frame support and offset front and rear wheels as shown in FIG. 3 so that it can be folded for storage. A preferred version of this asymmetrical side support kneeling walker illustrated in FIG. 1 not only can be easily folded, but it can be assembled with bolts either as a left or right immobilized leg version by rotating the front tubular frame assembly 180 degrees prior to assembly.

The kneeling walker can be manufactured from the same materials and with the same type of equipment used in the production of similar devices such as scooters, tricycles, wheelchairs, shopping carts, walkers, etc.

In particular the frame is steel tubing bent into shape, welded and bolted together. The steel tubing is thin walled cold rolled steel. Alternatively, tubular members fabricated of carbon fibers, aluminum, titanium, chromemolly or stainless steel may be utilized to reduce the weight without compromising strength. If desired, the lower ends of the tubing may be capped by a plastic or metal plug for strength. The platform may be extruded aluminum, molded plastic, carbon fibers, or aluminum, stainless steel, steel plate with the edges bent 90 degrees and the corners welded. The top of the adjustable platform is padded with foam rubber and covered for protection. The padding may be one piece inclined from front to back or two separate pads may be used with the rearward one higher than the forward one so that the foot is elevated with respect to the knee. The wheels with flanged bearing hubs are super tough nylon, with a pneumatic or non-pneumatic thermoplastic rubber molded on tire, non-marking, the type used on wheelchairs.

What I claim is:

1. A kneeling walker comprising:

a support frame, said support frame including at least two frame elements pivotally joined to thereby allow said frame to be pivotally folded;

a platform having a longitudinal length, horizontally disposed and connected to said support frame and adapted to receive a knee; said platform having a longitudinal centerline, said support frame has means for allowing height adjustment of platform;

a hand-grip means connected to at least one of said frame elements, said hand-grip and said platform sharing substantially a common centerline, said frame has means for allowing height adjustment of hand-grip;

at least two sets of two wheels each being rotatably connected to a lower end of said supporting frame wherein a first set of said wheels is connected to one side of said supporting frame at a location on one side of the centerline, wherein each wheel of said first set is an unequal distance from the centerline, and a second set of wheels being connected to a second side of said support frame on an opposite side of said centerline from said first set of wheels wherein each wheel of said second set of wheels is positioned an unequal distance from said centerline at a distance greater than either of the wheels in said first set of wheels and;

thereby providing an asymmetrical configuration of wheels connected to said supporting frame which provides increased stability to one side of said kneeling walker and increased foldability by orienting the wheels so as not to engage any of the other wheel upon folding, said supporting frame has means for allowing height adjustment of wheels.

* * * * *